US008561504B2

(12) United States Patent
Buchanan

(10) Patent No.: US 8,561,504 B2
(45) Date of Patent: Oct. 22, 2013

(54) WRENCH SOCKET

(76) Inventor: Nigel A. Buchanan, Fife (GB)

( * ) Notice: Subject to any disclaimer, the term of this patent is extended or adjusted under 35 U.S.C. 154(b) by 240 days.

(21) Appl. No.: 13/056,748

(22) PCT Filed: Jul. 31, 2009

(86) PCT No.: PCT/GB2009/001886

§ 371 (c)(1),
(2), (4) Date: Jan. 31, 2011

(87) PCT Pub. No.: WO2010/013013

PCT Pub. Date: Feb. 4, 2010

(65) Prior Publication Data

US 2011/0132151 A1 Jun. 9, 2011

(30) Foreign Application Priority Data

Jul. 31, 2008 (GB) ..... 0814013.9

(51) Int. Cl.
*B25B 13/00* (2006.01)

(52) U.S. Cl.
USPC ..... 81/124.3; 81/90.1; 81/121.1; 81/177.85

(58) Field of Classification Search
USPC ..... 81/90.1, 121.1, 123.4, 177.85
See application file for complete search history.

(56) References Cited

U.S. PATENT DOCUMENTS

| | | | |
|---|---|---|---|
| 1,411,970 | A | 4/1922 | Ligon |
| 1,754,717 | A | 4/1930 | Hughens |
| 2,370,837 | A | 3/1945 | Boynton |
| 2,522,428 | A | 9/1950 | Brunstad |
| 2,655,827 | A | 10/1953 | Johnson |
| 2,656,750 | A | 10/1953 | Rasco |
| 2,982,162 | A | 5/1961 | Golden |
| 3,161,091 | A | 12/1964 | Searcy |
| 3,741,047 | A | 6/1973 | Kanowsky |
| 3,885,479 | A | 5/1975 | Ono |
| 4,095,494 | A | 6/1978 | Castoe |

(Continued)

FOREIGN PATENT DOCUMENTS

| | | |
|---|---|---|
| DE | 22673 | 10/1882 |
| DE | 1603767 | 2/1971 |

(Continued)

OTHER PUBLICATIONS

International Search Report and Written Opinion of corresponding PCT Application No. PCT/GB2009/001886.

*Primary Examiner* — Lee D Wilson
*Assistant Examiner* — Shantese McDonald
(74) *Attorney, Agent, or Firm* — Gardner, Linn, Burkhart & Flory, LLP

(57) ABSTRACT

A wrench socket for use on fasteners such as pipework fittings where closed pipework or other obstructions would normally prevent the use of a ring wrench or closed sockets has a plurality of swivel arms pivotally mounted to a socket main body. The swivel jaws can be opened and closed as required around pipework and the fastener. Formations on the swivel arms align with one another when the swivel arms are closed allowing engagement by a drive bar that locks the swivel arms together. The swivel arms cooperate with the socket main body to define a polygonal fastener receiving aperture. The socket main body can be made thin profile to allow the wrench socket to be used in close proximity to obstructions that would prevent the operation of prior art wrenches and wrench sockets.

6 Claims, 4 Drawing Sheets

(56) References Cited

U.S. PATENT DOCUMENTS

| | | | | |
|---|---|---|---|---|
| 5,131,300 | A * | 7/1992 | Daniel | 81/111 |
| 5,549,022 | A * | 8/1996 | Knox | 81/124.2 |
| 6,286,398 | B1 | 9/2001 | Huang | |
| 2002/0104409 | A1 | 8/2002 | Hu | |
| 2006/0070498 | A1 * | 4/2006 | Buchanan | 81/90.1 |

FOREIGN PATENT DOCUMENTS

| | | |
|---|---|---|
| DE | 3504843 | 8/1986 |
| GB | 1307229 | 2/1973 |
| GB | 2065526 | 7/1981 |
| JP | 2001-205570 | 7/2001 |
| WO | 2004/069482 | 8/2004 |

* cited by examiner

WRENCH SOCKET

FIELD OF INVENTION

The invention relates wrench sockets.

BACKGROUND TO THE INVENTION

The head portion of a ring wrench or socket usually has an inner shape and size complementary to that of a typically hexagonal or square fastener head. The head of such a socket or wrench has an inner surface which surrounds the fastener head with only a small amount of clearance between the inner surface of the socket or wrench and fastener head. A torque applied to the socket or wrench head is transmitted to the fastener head to turn the fastener.

Sockets or ring wrenches are preferable to open jaw type wrenches because the torque transmitted to the fastener is applied via a much larger contact area. Also a socket or ring wrench can transmit a far greater torque without harmful distortion of the fastener head and less chance of the socket or wrench head damaging or slipping off the fastener. Ring wrenches are preferable of the closed head type in order to transmit adequate torque to the fastener without the ring head opening under the applied torque causing damage or slippage. Closed ring sockets or wrenches, however, are incapable of use on pipe work fittings and fasteners where closed pipe work or other obstructions such as a vehicle tie rod prevent the fasteners being accessed. Likewise most known sockets and their various operating means cannot be used for the same reason.

Sockets that can open and close, known generically as butterfly sockets, are known. The known butterfly sockets comprise two arms connected by a swivel pin. The two arms can swivel outwards in order to access the fastener to be worked then closed around the periphery of the fastener. When the butterfly socket is closed, a spigot drive of an operating handle can be inserted through respective overlapping apertures provided in the free ends of the arms in order to lock the arms in the closed position. The known butterfly sockets incorporate a substantial swivel pin, which passes through the ends of the arms opposite the free ends. Because the free ends of the arms have to be made relatively wide to allow the provision of the apertures and the opposite ends have to be relatively wide to accommodate the swivel pin, the known butterfly sockets are relatively large, at least along a line extending though the opposite ends of the butterfly socket when closed. This can make it difficult or impossible to use such sockets when there are further pipe nuts, fasteners, fixings or other obstructions that would foul the movement of the socket.

It is an object of the invention to at least partially alleviate the above mentioned disadvantages and/or provide an alternative to existing products.

SUMMARY OF THE INVENTION

The invention provides a wrench socket for operation by a torque applying device, the wrench socket comprising a body portion and two arms connected to the body portion so as to be movable between open positions in which respective free ends of the arms are spaced apart and a closed position in which respective engagement portions of the arms are engagable by a male drive member of a torque applying device to lock the arms in said closed position in which said body portion and arms define a polygonal fastener receiving aperture.

The invention also includes a wrench socket having a polygonal fastener receiving aperture and comprising a main body portion having a through hole defined by at least two sides of said polygonal fastener receiving aperture and two arms separately connected to said main body portion and provided with respective formations engageable with a drive applying device, said arms being movable relative to said main body portion between a position in which respective free ends thereof are spaced apart to provide a side opening to said through hole and a closed position in which said arms close said opening and define at least one side of said polygonal fastener receiving aperture, the arms being arranged such that when in said closed position said formations are positioned to cooperably engage a said drive applying device such that the drive applying device locks the arms in said closed position and can apply a torque to the wrench socket.

The invention also includes a method of applying a torque to a fastener that has an elongate member extending axially through a though hole thereof using a wrench socket as specified in the last preceding paragraph, said method comprising:

positioning said arms in a said open position, causing relative movement of the wrench socket and elongate member such that the elongate member passes between said arms and through said side opening and into the through hole of the main body, moving said arms to said closed position, causing relative movement of the wrench socket and elongate member to position the fastener in said polygonal fastener receiving aperture, cooperably engaging said formations with a said drive applying device, and applying a torque to the wrench socket with said drive applying device.

One embodiment of the wrench socket includes a main body portion and two swivel jaws capable of pivotal movement in the same plane around respective axis pins, that fix and secure the swivel jaws to the main body portion. When a fastener drive surface of the wrench socket is closed around an appropriately sized fastener, cooperating lock/drive portions of the swivel jaws provided at the end of the arms remote from the axis pins are aligned to enable an appropriately sized drive spigot of an operating bar to enter and engage both swivel jaws. The wrench socket is locked and held closed by the operating bar drive spigot providing an inherently strong closed ring head socket, which can be conveniently operated by an operating bar, socket bar or ratchet means to apply torque in the required direction to the fastener being operated.

The axis pin portions and lock/drive portions may be interlocking but allow relative movement there between. The lock/drive portions may comprise a square drive hole similar to that used by fastener sockets so that the wrench socket can be operated by known socket operating means.

A polygonal shaped fastener drive surface of the wrench socket may be shaped so that its contact with a polygonal drive surface of a fastener is via the parts of the flanks of each drive surface of the fastener best capable for transmitting torque in the direction of torque application.

Although the described embodiments are only capable of use in one direction, the improved profile of the swivel jaw fastener drive surface may allow a range of near sized fasteners to be operated using the same socket drive.

BRIEF DESCRIPTION OF THE DRAWINGS

In order that the invention may be well understood, some embodiments thereof, which are given by way of example only, will now be described with reference to the drawings, in which.

DESCRIPTION OF THE ILLUSTRATED EMBODIMENTS

Figures 1, 2, 3, 4, 5:
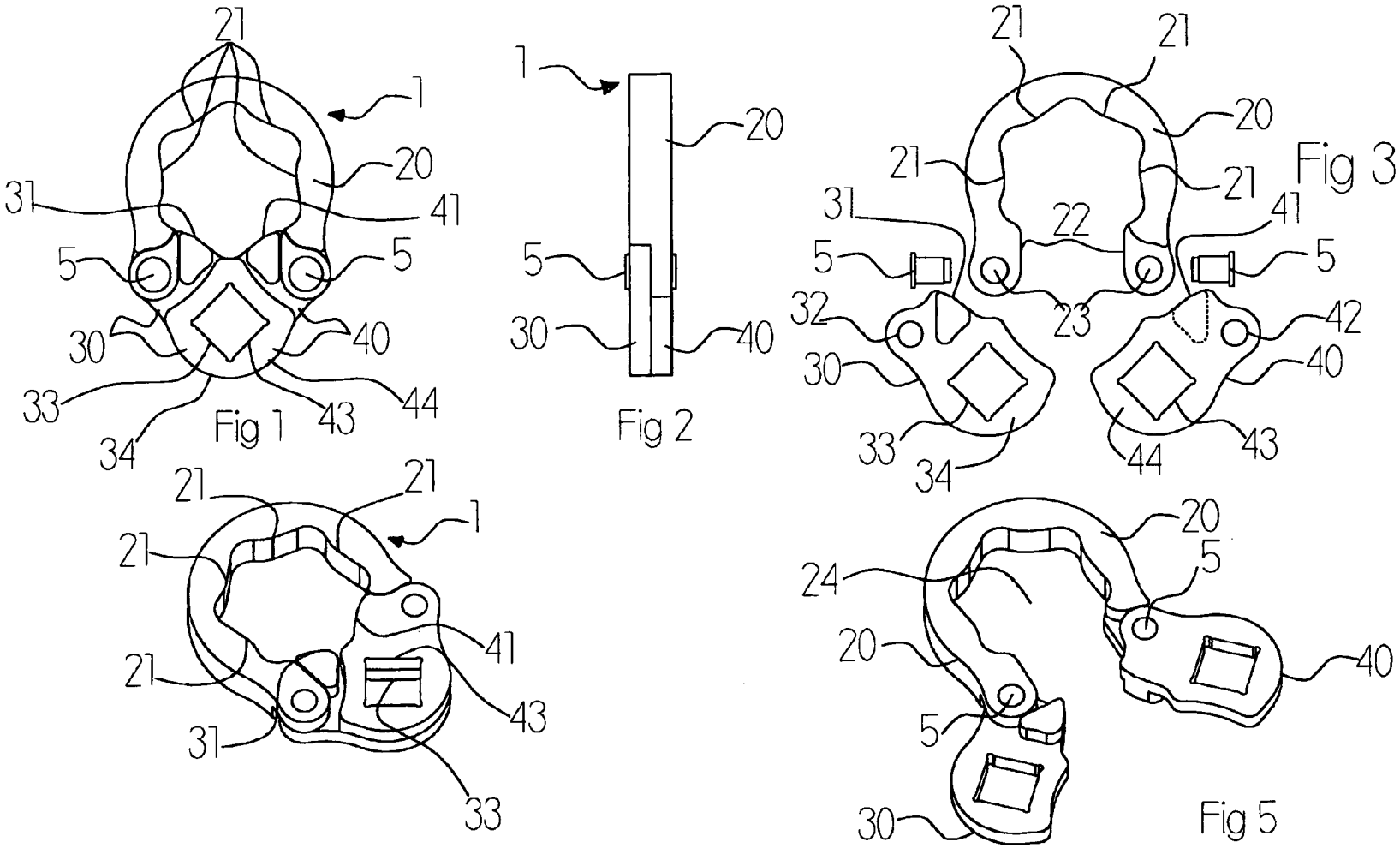
FIG. 1 is a top plan view of a wrench socket in a closed condition.
FIG. 2 is a side view of the wrench socket of FIG. 1.
FIG. 3 shows the wrench socket dismantled.
FIG. 4 is a perspective view of the wrench socket of FIG. 1.
FIG. 5 is a perspective view of the wrench socket of FIG. 1 in an open condition.

FIG. 1 illustrates a wrench socket 1 comprising a main body 20 a plurality of swivel jaw arms 30, 40 capable of pivotal movement in the same plane about respective axis pins 5. The axis pins 5 secure the swivel jaw arms 30,40 to the main body 20. The swivel jaw arms 30,40 when closed as shown allow the jaw ends 34,44 to overlie each other such that lock/drive apertures 33,43 of the swivel jaw arms cooperate to define a formation for engagement by a drive device. The swivel jaw arms 30, 40 define fastener drive surfaces 31,41 that in combination with main body fastener drive surfaces 21 define a fastener receiving aperture.

FIG. 2 shows the wrench socket 1 in end profile with the main body 20 connected to the swivel jaw arms 30,40 by the axis pins 5. The wrench socket 1 is shown in the closed position also shown in FIG. 1.

FIG. 3 shows the wrench socket 1 dismantled into its component parts. The main body 20 has a plurality of fastener drive surfaces 21 and axis pin apertures 23 at its free ends 22. The axis pins 5 connect the swivel jaw arms 30,40 to the main body 20 through axis pin apertures 23,32,42. The lock drive apertures 33,43 are situated at the jaw ends 34,44. The swivel jaw fastener drive surfaces 31,41 are situated at the laminate pin aperture end of the swivel jaw arms.

FIG. 4 illustrates in perspective the wrench socket 1 in the closed position with the jaw ends 34,44 overlying one another such that the lock/drive apertures 33,43 substantially form one profile. In the present example, the drive surfaces 21,31, 41 form a hexagonal fastener receiving aperture.

FIG. 5 shows the wrench socket 1 in the open position the swivel jaw arms 30,40 swiveled around the axis pins 5 which to allow a pipe or the like (not shown) to access the fastener receiving aperture. It will be noted that the swivel jaw arms 30,30 are mirror images and each has a raised section such that the fastener drive surfaces 31,41 have a uniform thickness corresponding substantially to the thickness of the main body 20.

Figure 6:
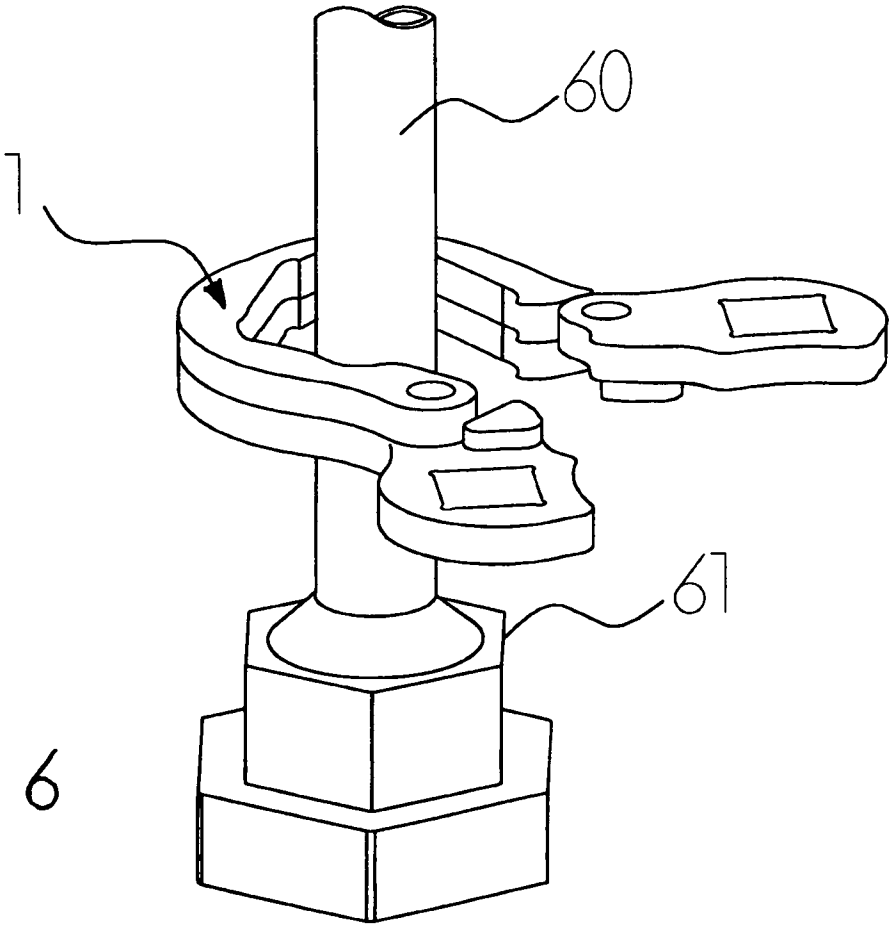
FIG. 6 shows the wrench socket located around a pipe.

FIG. 6 illustrates the wrench socket 1 in the open position with pipework 60 having accessed the fastener receiving aperture. The pipework 60 includes a fastener 61.

Figure 7:
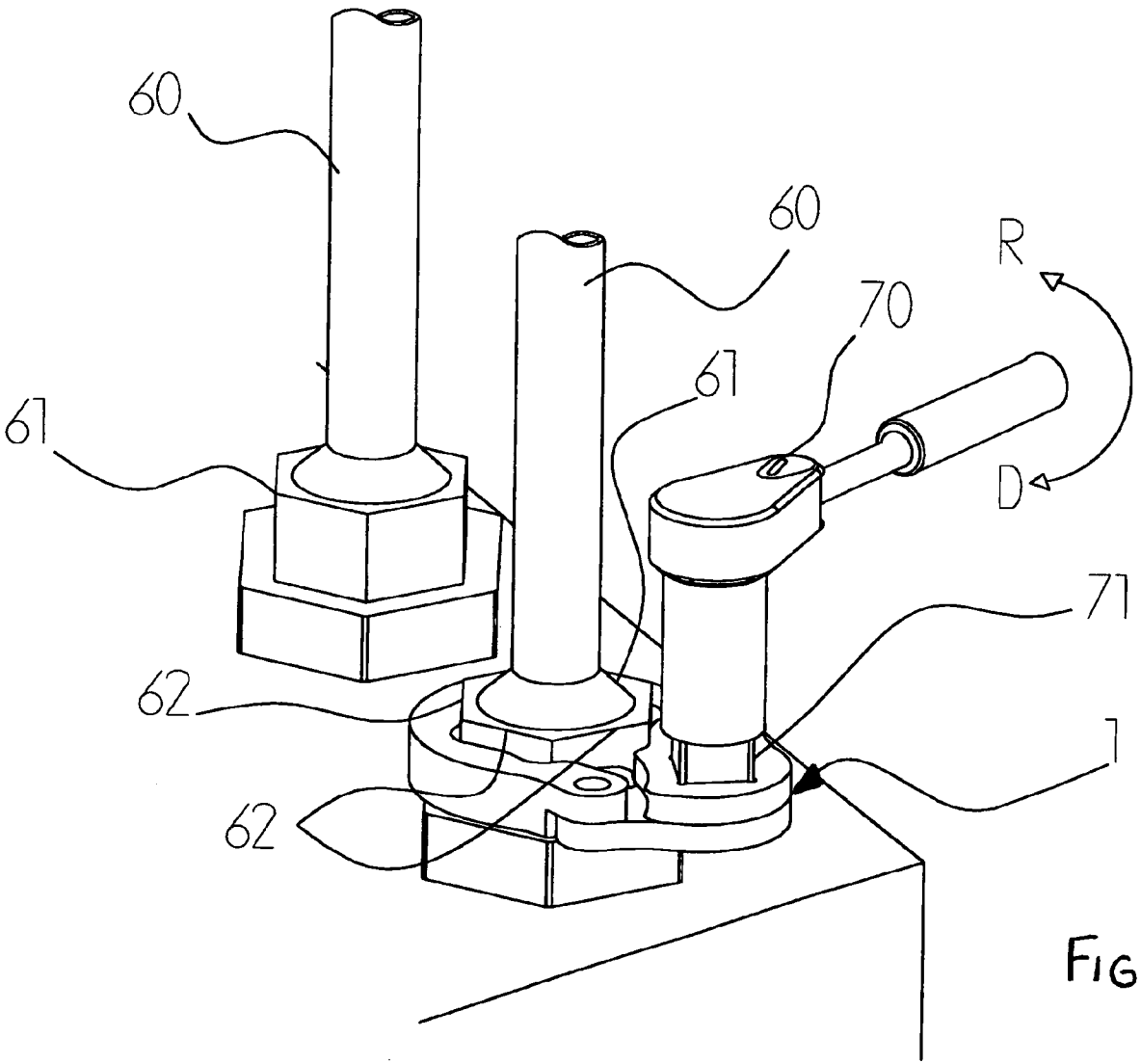
FIG. 7 shows a ratchet drive bar engaging the wrench socket.

FIG. 7 illustrates the wrench socket 1 engaged upon a fastener 61, which in this example has a hexagonal drive surface 62. A drive bar 70 can be operated in the drive direction D, or the reverse direction R, in order to tighten or loosen the fastener 61 as required. As the main body 20 periphery is slim in profile the wrench socket 1 can be utilised in confined spaces specifically those where there are other fasteners 61, pipework 60 or any obstruction that would prevent the use of known butterfly sockets with their large profile swivel joints within the "main body" periphery.

Figure 8:
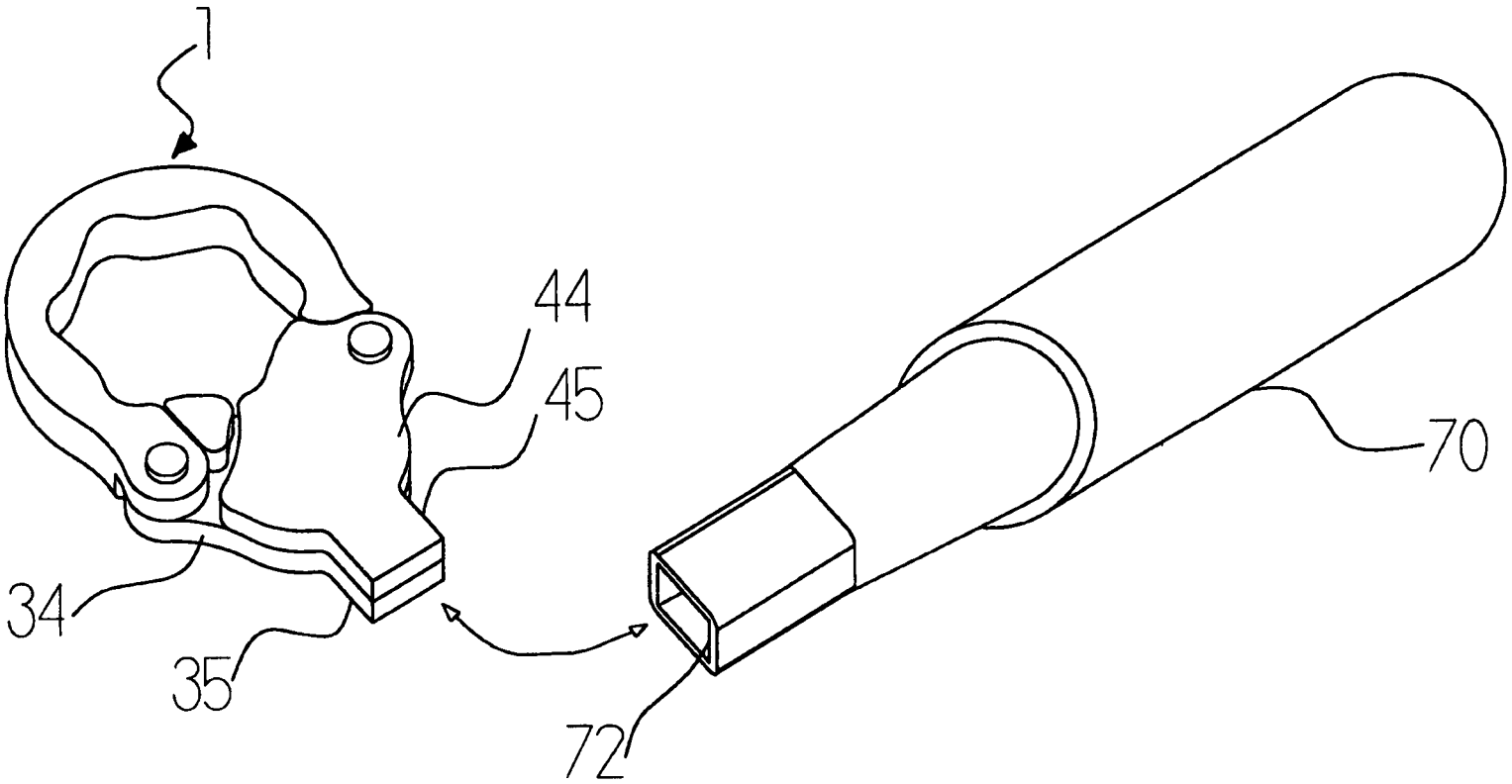
FIG. 8 shows another wrench socket.

FIG. 8 illustrates a further example of a wrench socket 1. Instead of lock/drive apertures 33,43, this wrench socket has rectangular lock/drives 35,45. When the swivel jaw arms overlap, the lock/drives 35,45 are engageable by a drive bar 70 having a corresponding shaped recess 72 for engaging the rectangular lock/drive 35,45 of the to drive the socket. The internal surfaces of the wrench socket 1 that define the fastener receiving aperture are the same as those described with reference to FIGS. 1 to 5 and will not be described further.

It will be appreciated that the wrench sockets shown in FIGS. 1 and 8 provide the potential for making a more compact wrench socket than known butterfly sockets by having a plurality of swivel arms 30, 40 pivotally mounted in the same plane and fixed and secured together at a drive surface end 31, 41 by an axis pin 5. These swivel arms 30,40 advantageously open and close as required around obstructive metal work or pipework 60 in order to engage a fastener 61 that is to be tightened or slackened. In the FIG. 1 embodiment, when the swivel jaw arms 30,40 are fully closed the lock/drive apertures 33,43 align with each other so that an appropriate drive spigot 71 can engage the lock/drive apertures 33,43 to lock the swivel jaw arms 30,40 in a closed position around a fastener or the like. Torque to drive the wrench socket bar can then be applied to tighten or slacken the fastener as required.

The wrench socket shown in FIG. 8 is configured such that the ends of the swivel jaw arms 30,40 form a rectangular shape 35,45 that can be engaged to by an open ended wrench or spanner, or by a socket bar recess 72, to turn the wrench socket. It is possible to combine this alternative configuration with the provision of lock/drive apertures 33,43 so that the wrench socket 1 can be operated using a wider range of torque applying devices.

It will be understood that the fastener receiving aperture of the wrench socket is polygonal and may have three or more sides. In the illustrated embodiments, the movable arms complete two sides of a hexagonal fastener receiving aperture. It will be understood that the arms may configured so as to form to complete sides, or form or complete just one side.

In the illustrated embodiments, the swivel jaw arms overlap one another when the wrench socket is in its closed position. Although not essential, it is preferable that the portions of the swivel jaw arms that overlie one another when close are both thinner than the main body portion, their thickness being such that when overlapping they have a combined thickness corresponding substantially to that of the main body portion.

It will be understood that it is not essential for the swivel jaw arms to overlap when in the closed position. Instead, they may be configured to abut in side-by-side relation.

It will be appreciated that the formations 35, 45 do not have to be rectangular and could for example be semi-circular or form half of a hexagon.

The invention claimed is:

1. A wrench socket comprising:

a main body portion having a through hole and a side opening to said through hole;

two arms separately connected to said main body portion and provided with respective formations engageable with a drive applying device;

wherein said arms are movable relative to said main body portion between an open position in which respective free ends thereof are spaced apart to open said side opening to said through hole and a closed position in which said arms close said side opening; wherein a sidewall of said through hole defines at least three sides of a polygonal fastener receiving aperture, and wherein said arms when in said closed position define at least one side of said polygonal fastener receiving aperture;

wherein the arms are arranged such that when in said closed position said formations are positioned to cooperably engage a said drive applying device such that the drive applying device locks the arms in said closed position and can apply a torque to the wrench socket;

wherein said fastener receiving aperture has a centre, a first axis disposed in a plane and extending through said formations and said centre and a second axis disposed in said plane, said second axis extending through said centre and said main body portion and perpendicular to said first axis; and wherein respective locations at which said arms are connected to said main body portion and said formations when said arms are in said closed position are all disposed to one side of said second axis.

2. A wrench socket as claimed in claim 1, wherein said formations comprise polygonal apertures disposed generally one above the other when said arms are in said closed position for receiving a male part of a said drive applying device.

3. A wrench socket as claimed in claim 2, wherein said formations comprise respective fingers at the free ends of the arms that when the arms are in the closed position cooperate to define a male member receivable in a female portion of a said drive applying device.

4. A wrench socket as claimed in claim 1, wherein when in said closed position said arms are disposed in overlying relation.

5. A wrench set comprising a said drive applying device and at least one wrench socket as claimed in claim 1.

6. A method of applying a torque to a fastener that has an elongate member extending axially through a though hole thereof using a wrench socket as claimed in claim 1, said method comprising:

positioning said arms in a said open position, causing relative movement of the wrench socket and elongate member such that the elongate member passes between said arms and through said side opening and into the through hole of the main body, moving said arms to said closed position, causing relative movement of the wrench socket and elongate member to position the fastener in said polygonal fastener receiving aperture, cooperably engaging said formations with a said drive applying device, and applying a torque to the wrench socket with said drive applying device.

* * * * *